US006010052A

United States Patent [19]

Leins et al.

[11] Patent Number: 6,010,052

[45] Date of Patent: Jan. 4, 2000

[54] YARN SUPPLY APPARATUS WITH ELECTRONIC CONTROL

[75] Inventors: Eberhard Leins, Heiningen; Hermann Schmodde, Horb-Dettlingen; Friedrich Weber, Herzogsweiler; Josef Fecker, Bisingen; Ludwig Ketterer, Schramberg, all of Germany

[73] Assignee: Memminger-Iro GmbH, Dornstetten, Germany

[21] Appl. No.: 09/051,158

[22] PCT Filed: Sep. 17, 1996

[86] PCT No.: PCT/DE96/01751

§ 371 Date: Apr. 2, 1998

§ 102(e) Date: Apr. 2, 1998

[87] PCT Pub. No.: WO97/13906

PCT Pub. Date: Apr. 17, 1997

[30] Foreign Application Priority Data

Oct. 6, 1995 [DE] Germany ..... 195 37 325

[51] Int. Cl.[7] ..... B23Q 15/00

[52] U.S. Cl. ..... 226/44; 226/45; 242/365.7; 242/418.1; 66/211; 66/146

[58] Field of Search ..... 226/44, 42, 45; 242/365.7, 418.1, 418; 66/210, 211, 213, 146; 28/194; 139/110

[56] References Cited

U.S. PATENT DOCUMENTS

| | | | |
|---|---|---|---|
| 2,876,004 | 3/1959 | Sink | 226/42 |
| 3,858,416 | 1/1975 | White et al. . | |
| 4,605,044 | 8/1986 | Sakano | 66/210 X |
| 4,720,985 | 1/1988 | Goller et al. | 66/146 |
| 4,752,044 | 6/1988 | Memminger et al. . | |
| 4,829,790 | 5/1989 | Memminger et al. | 66/146 X |
| 4,942,908 | 7/1990 | Imamura | 139/110 X |
| 4,966,333 | 10/1990 | Bosch | 28/194 X |
| 5,375,435 | 12/1994 | Gille et al. | 66/211 |
| 5,421,534 | 6/1995 | Arnold et al. | 226/42 X |
| 5,423,197 | 6/1995 | Roser | 242/365.7 X |

FOREIGN PATENT DOCUMENTS

| | | | |
|---|---|---|---|
| 0117479 | 9/1984 | European Pat. Off. | 139/110 |
| 0 161 853 | 11/1985 | European Pat. Off. . | |
| 0 362 521 | 4/1990 | European Pat. Off. . | |
| 15 85 166 | 3/1970 | Germany . | |
| 2363411 | 7/1975 | Germany | 66/210 |
| 30 02 311 | 7/1981 | Germany . | |
| 3111113 | 10/1982 | Germany | 66/210 |
| 38 20 618 C2 | 12/1989 | Germany . | |
| 61-296146 | 12/1986 | Japan | 139/110 |
| WO 90 09625 | 8/1990 | WIPO . | |

*Primary Examiner*—Donald P. Walsh
*Assistant Examiner*—Minh-Chau Pham
*Attorney, Agent, or Firm*—Frishauf, Holtz, Goodman, Langer & Chick, P.C.

[57] ABSTRACT

For supplying yarns, a yarn supply apparatus is contemplated that is designed particularly for knitting machines whose yarn demand fluctuates greatly over time. The yarn supply apparatus has a rotor-driven yarn wheel, which in the ideal case furnishes yarn directly to the knitting machine or its yarn guides without the interposition of yarn storage devices. The yarn tension is monitored by means of a yarn tension sensor, which provides measured value detection for a closed-loop controller that controls the supply by the yarn wheel. The controller is also embodied such that it can process signals that contain information about the future yarn demand. Thus in the event of imminent drastic changes in demand, of the kind that in flatbed knitting machines periodically occur at the edges of the knitted goods (turning points of the yarn guide), the controller can react by pre-supplying yarn or by ceasing to supply yarn. Yarn tension spikes and overly steep yarn tension drops can thus be compensated for. The controller may be designed such that it functions as a closed-loop status controller and intermittently as an open-loop controller. Other provisions, such as disturbance variable compensation, parameter adaptation, or the like, are possible.

25 Claims, 5 Drawing Sheets

YARN SUPPLY APPARATUS WITH ELECTRONIC CONTROL

FIELD OF THE INVENTION

The invention relates generally to a yarn supply apparatus, and more particularly to a yarn supply apparatus for supplying elastic and inelastic (hard) yarns, ribbons, strands, and the like.

BACKGROUND OF THE INVENTION

Yarn supply apparatuses in knitting machines have the task of supplying the corresponding knitting stations with yarn of the requisite tension and in the desired quantity at the correct time in each case. The constancy of the yarn tension substantially determines the uniformity of the knitted product produced.

Fluctuations in the tension of the supplied yarn, especially when they recur systematically in one row of loops after another, can cause a marked impairment of quality of the resultant knitted goods. Fluctuations in yarn tension can occur when the yarn demand abruptly changes over time. This is the case for instance in flatbed knitting machines when at the turning point of the yarn guide there is suddenly no yarn consumption. If the yarn tension then fluctuates, the result is different loop widths at the edges of the resultant knitted goods than in the middle.

Especially with hard yarns, because of the nonexistent capability of the yarn to expand, the yarn tension depends on the yarn supply quantity, which should match yarn consumption as closely as possible at the particular current time.

For applications with yarn consumption that fluctuates over time, the yarn supply apparatus known from German Patent DE 36 27 731 C1 was developed; it has a yarn wheel driven by a stepping motor. The yarn wheel carries the yarn, drawn from a yarn bobbin, to the applicable knitting station via a yarn brake. The yarn supplied by the yarn wheel travels through a terminal eyelet of a lever supported pivotably on its other end. The eyelet represents a turning point, at which the yarn is rerouted at an acute angle. To adjust a constant yarn tension, the pivot lever is acted upon by a constant torque by means of a direct current motor. The pivot lever is also connected to a position transducer, which detects its pivoted position and readjusts the stepping motor accordingly. The pivot lever, in cooperation with the sensor device, thus serves to detect the existing yarn supply.

A closed-loop controller compares the position of the pivot lever with a command value and accelerates or decelerates the motor if the command value is exceeded or undershot. To compensate for sudden changes in demand, which the motor cannot follow instantaneously because of its moment of inertia, the pivot lever forms a yarn store, which can temporarily store a limited length of yarn.

On sudden changes in yarn demand, the pivot lever must be speeded up. The moment of mass inertia of the pivot lever has an effect on the yarn tension and impairs the constancy thereof.

From German Patent DE 38 20 618 C2, the yarn supply apparatus for kinky and other effect yarns is known, which has two rotationally driven yarn wheels, rotating in opposite directions, around which the yarn to be supplied is wrapped multiple times in a figure eight. An arm carrying an eyelet on its end and acted upon by torque in a predetermined direction of rotation acts as a yarn store for temporarily storing yarn intermittently not drawn off by the knitting stations. The yarn travels at an acute angle through its terminal eyelet, and for temporary storage it is deposited on bolts or posts located along a circle around the arm.

Frictional effects that affect yarn travel occur both on the bolts or posts forming a temporary store and at the eyelet of the arm through which the yarn travels at an acute angle.

From German Patent Disclosure DE 42 06 607 A1, a yarn supply apparatus for simultaneously supplying two yarns to a knitting machine is known, in which a yarn supply wheel is driven by a disk rotor motor. At least one yarn travels from the yarn supply wheel through the longitudinal opening of a helical spring wound in a conical or trumpet shape. A permanent magnet and a Hall sensor are provided on a bearing that pivotably holds the helical spring on one end, to enable detecting deflections of the helical spring. On the basis of these deflections, the disk rotor motor is readjusted, so that the command length of the helical spring is established in steady-state operation. In that position, the yarn travels laterally along the inner wall of the helical spring, through the opening in it. The helical spring acts as a spring and damping element, which allows a certain temporary storage of supplied yarn.

Yarn supplied because of the moment of inertia of the disk rotor motor is received by the temporary store, which changes the yarn tension.

Finally, U.S. Pat. No. 3,858,416 discloses a yarn supply apparatus which is suitable for knitting machines that have substantially constant yarn consumption and for supplying hard yarns. The yarn supply apparatus has an electric motor whose rpm is controllable via the applied voltage and which by means of a suitable yarn wheel draws yarn from a bobbin and delivers it to the appropriate knitting station via a yarn tension sensor. A command value transducer is also present, which is connected to a command value input of a closed-loop controller, via a reversing switch and via selectively actuatable adjusting devices. Via the reversing switch, the controller receives a signal, characterizing the yarn tension, at its actual value input, and it readjusts the motor accordingly. Rpm sensors are also present on the electric motor and on the knitting machine; given a suitably different switch position of the reversing switch, they can be connected to the command value and actual value inputs of the controller. The reversing switch allows a switchover from one operating mode, with a yarn tension regulated so that it is constant, to an operating mode with a defined yarn supply quantity. Each knitting station of the circular knitting machine is assigned a corresponding yarn supply apparatus; so that the quantity of yarn to be supplied corresponds to the yarn consumption of a knitting station. The yarn travel speed is correspondingly low.

There are no provisions made for temporarily storing any possible excess lengths of yarn supplied as a result of motor inertia or motor characteristics or suddenly required to be paid out. Sudden changes in yarn demand, because of the reaction time of the controller and of the connected motor, therefore cause yarn tension spikes, which in an extreme case can lead to yarn breakage.

OBJECTS AND SUMMARY OF THE INVENTION

Based on the above, it is an object of the invention to create a yarn supply apparatus by means of which knitting machines can be supplied with yarns at high speeds, which can change abruptly, at a desired yarn tension while avoiding tension spikes.

This object is attained with a yarn supply apparatus as defined by the claims.

The yarn supply apparatus is embodied as a feed wheel mechanism. It has a yarn wheel, which is driven by means of an electric motor and is located in the yarn travel path, and about which the yarn wraps multiple times. The electric motor, preferably a disk rotor stepping motor, is triggered by a controller that regulates to a constant yarn tension. To detect the yarn tension, a tension sensor connected to the controller is provided, which preferably has an only slight measurement travel. This travel is in the millimeter range. It is thus attained that measuring the yarn tension can be done essentially without feedback and with high dynamics. Accordingly, the yarn tension sensor does not form a yarn store.

The controller is designed such that it can process not only the actual value of yarn tension and the command value for the yarn tension but also other information having to do with the yarn demand in the future. It is thus possible shortly before the sudden occurrence of a peak demand to accelerate the drive motor of the yarn supply apparatus and in a sense to supply yarn in advance. The subsequent peak demand uses up this resupplied yarn reserve, while the drive motor continues to accelerate to its required rotational speed. In this way, the yarn tension desired for the knitting operation is attained without the occurrence of dangerously high yarn tensions. The danger for yarn tearing or breakage can be reduced considerably in this way, and at the same time the quality of the knitted product, in terms of the uniformity of the loop size, is increased.

To generate and process the signal that contains information about future yarn demand, there are various possible options. For instance, the signal can be imposed on the difference, produced at the controller input, between the command and actual values for the yarn tension. This compensation can be done depending on the sign, by addition to or subtraction from the resultant difference, or by other operations. Another option is to link the signal either to the command value or the actual value before the difference between the command and actual values is formed. In all cases, it is attained that a variable which is generated from the command value, the actual value, and the additional signal is present at the input of the actual controller.

In simple cases, it can suffice to limit the information about future yarn demand to merely that for the imminent yarn demand, that is, yarn demand in the immediate future. To that end, the yarn tension can be determined in advance for a predetermined length of time and/or travel distance.

A further variant is to temporarily fade out the yarn tension signal and the control of the drive device on the basis of the additional signal. In that case, the closed-loop controller intermittently functions as an open-loop controller.

In a simple variant, the additional signal may be a signal that contains only information about imminent yarn demand. This can be attained with a binary signal that changes its value at a fixed time interval before the occurrence of yarn demand. On the basis of this signal, the drive motor for the yarn wheel can be prematurely started or stopped.

Linking the binary signal, or some other signal that contains information about future yarn demand, can be done both to the command value and to the actual value. In all cases, excessive increase in the yarn tension (yarn tension peaks or spikes) and an excessive decrease in yarn tension (yarn tension drop) are prevented.

To compensate for the requisite reaction time of the motor resulting from its moment of inertia and because its maximal acceleration is limited for other reasons as well, it is possible at the outset to specify to the controller, instead of a constant command value for the yarn tension, a command value profile that is superimposed on the expected control deviations in whatever yarn tension is desired. In the simplest case, the command value profile is formed by a yarn tension command value, which in flat bed knitting machines assumes different values for the forward and return travel of the yarn guide. The command value profile may be dependent on the machine running speed, so that tension peaks and tension drops are largely suppressed, even when machine running speeds vary.

In a modified embodiment, the controller determines the requisite yarn supply adaptively. To that end, it stores the detection yarn tension, for instance, in memory. In the next operating cycle, whose beginning can be indicated by a signal furnished by the knitting machine, the yarn supply is set at the outset such that in the preliminary cycle, existing tension peaks are either reduced or are not produced in the first place. Proceeding in this way is suitable especially for knitting machines on which unpatterned goods, or goods with simple, constantly repeating patterns are knitted.

The controller can also learn the requisite yarn supply quantity from other parameters, such as from the pulses supplied to the drive motor.

It is moreover possible to determine the control characteristic of the controller adaptively and to adapt it to operating conditions. The solutions discussed above are suitable for yarn supply apparatuses that can be mounted retroactively on knitting machines without requiring major intervention in the knitting machines. In a version that is also suitable for complicated yarn supply conditions, the controller of the yarn supply apparatus is connected to the pattern memory present in the knitting machine. Thus from the pattern to be knitted, the current and future yarn supply quantities needed are determined and are supplied to the controller as additional information about the yarn tension. Anticipating future demand peaks or sudden future absence of demand, the controller can as a result, at the proper time, speed up or slow down the drive device, which has moment of inertia, and the yarn wheel.

If the yarn travel path between the yarn wheel and the knitting machine is embodied as nonresilient, then in the case of hard yarns, yarn storage effects and the effects of inertia, which would otherwise affect the controller, can be reduced. It is therefore also advantageous if the measurement travel of the yarn tension sensor is very slight, preferably in the range of approximately 1 mm. Measuring the yarn tension is thus done substantially without affecting the yarn tension, or in other words without feedback.

For temporary storage of lengths of yarn that represent a temporary control deviation, a yarn store may be provided. When the yarn supply apparatus is used for elastic yarns, one travel segment between the yarn wheel and the knitting machine can be embodied as a yarn store. A certain buffer effect ensues because of the expansibility of the yarn.

High drive dynamics are attained if the drive device is embodied as a stepping motor. Disk rotor motors and especially disk rotor stepping motors make rapid runup to operating speed and rapid braking down of the yarn wheel possible.

Between the yarn tension sensor and the connected controller, a filter may be provided that suppresses disturbance. This can be done by blocking disturbance frequency ranges. Moreover, the tension sensor may be provided with compensation means for suppressing disturbance signals.

BRIEF DESCRIPTION OF THE DRAWINGS

In the drawing, exemplary embodiments of the invention are shown. Shown are.

DETAILED DESCRIPTION OF THE PREFERRED EMBODIMENTS

Figure 1:
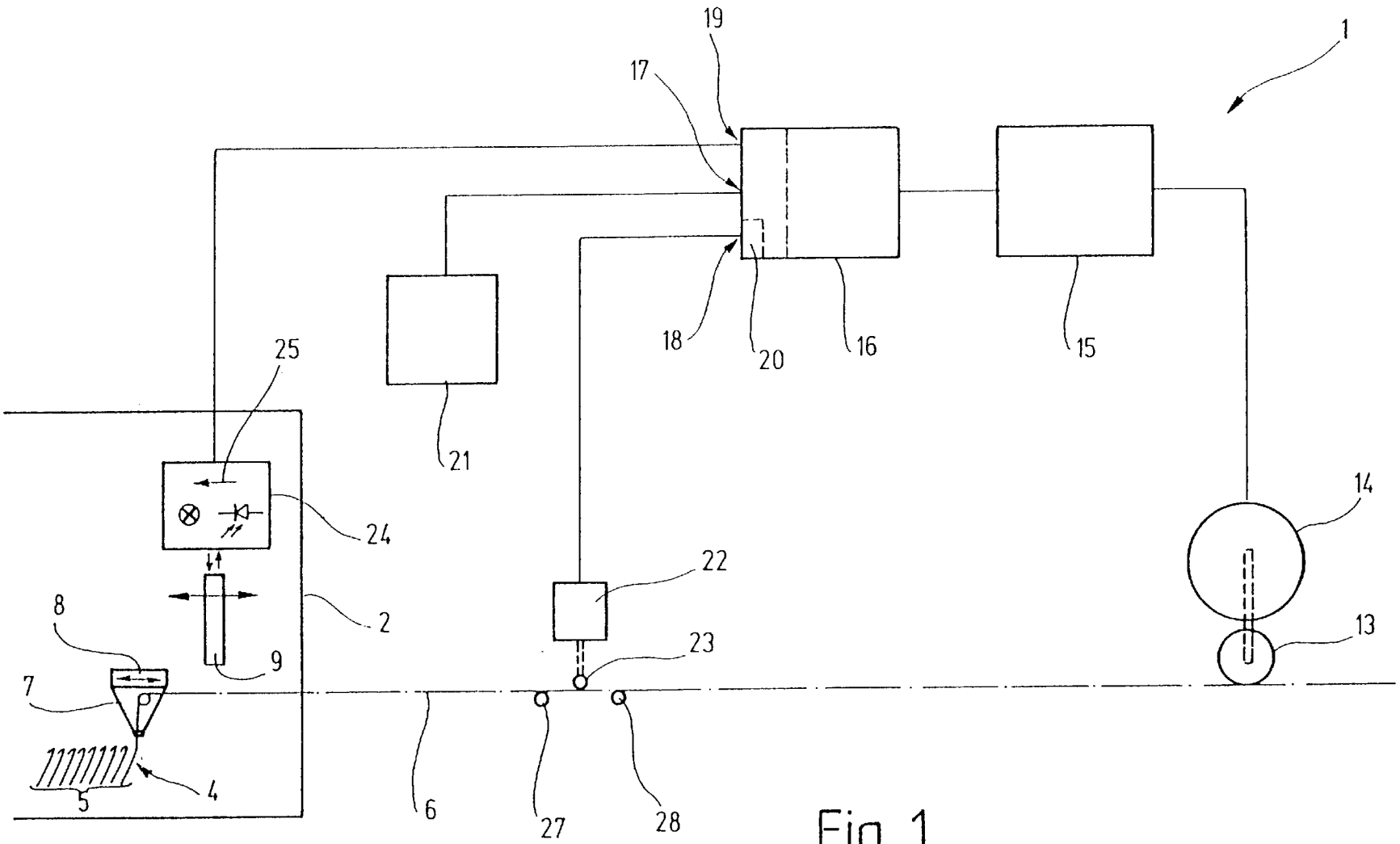
FIG. 1, in a schematic illustration, a flatbed knitting machine with a yarn supply apparatus, which is guided by a controller on the basis of the yarn tension and on the basis of a further signal, which is output by a direction-detecting sensor device that is provided for monitoring a machine element of the knitting machine.

In FIG. 1, a flatbed knitting machine 2 provided with a yarn supply apparatus 1 is shown schematically. The flatbed knitting machine 2 has at least one row 4 of latch needles 5, arranged in a line, which are projected and retracted at the pace of the machine, in the manner of a continuous wave. The supply of a hard or in other words inelastic yarn 6 to the needles 5 is performed by a yarn guide 7, which is driven to reciprocate as indicated by the arrow 8. A carriage 9, which moves back and forth along the row 4, serves to drive the yarn guide 7. The carriage 9, during its travel, causes the yarn guide 7 to stop at the end of the row 4, then reverses its direction of motion and subsequently carries the yarn guide along again. This takes place in both directions of motion and at both turning points.

For feeding and supplying the yarn 6 to the yarn guide 7, the yarn supply apparatus 1 has a yarn wheel 13 with a low moment of mass inertia; the yarn wheel is disposed in the yarn travel path, and the yarn 6 wraps around it a few times. The yarn wheel 13 is formed by six wire hoops, for instance, extending radially away from a hub. These hoops have yarn support segments oriented in the axial direction and arranged at the corners of a regular hexagon. The hub of the yarn wheel 13 is firmly joined to the rotor of a disk rotor stepping motor 14, which is triggered by a closed-loop controller 15 and forms a drive device with low moment of inertia.

The controller 15 is designed such that as needed, it can fully accelerate the disk rotor stepping motor 14, but with certainty keeps it in safe operating ranges, so that the disk rotor stepping motor 14 cannot fall out of step or undesirably come to a stop.

The controller 15 is preceded by a processor 16 for determining the control deviation; the processor may be embodied as an analog or digital or computer circuit. The processor 16 has a command value input 17, an actual value input 18, and an additional input 19. If needed, the actual value input 18 may be provided with a filter 20, which serves to filter out disturbance frequencies and is embodied as a bandpass filter, band elimination filter, or high- or low-pass filter.

The command value input 17 is connected to a command value generator 21, which specifies a fixed value for the tension of the yarn 6. The actual value input 18 is connected to a low-vibration yarn tension sensor 22 suspended in damped fashion, which samples the yarn tension via a feeler element 23. The additional input 19 is connected to a directionally dependent sensor device 24 provided on the flatbed knitting machine 2; by means of a photoelectric gate, the sensor device detects the motion of the carriage 9, especially in the region of the turning point. The sensor device 24 outputs a signal when the carriage 9 passes through a predetermined region in the direction of the arrow 25, or in other words toward the yarn guide 7. This signal is utilized by the processor 16 as an additional criterion for triggering the controller 15. The sensor device 24 also generates a signal that characterizes the speed of the carriage 9 traveling past it, and it furnishes this signal to the processor 16. If needed, at the appropriate turning point on the opposite side, a further sensor device may be provided to detect the carriage motion; it is likewise connected to the processor 16.

For determining the control deviation to be sent to the controller 15, the processor 16 forms the difference between the signals present at the command value input 17 and the actual value input 18. In steady-state operation of the controller, this difference forms the control deviation. The additional input 19 now serves to simulate a control deviation in a certain sense, even though the tension of the yarn 6 is at its intended value or is within a predetermined tolerance range. Thus, as will become apparent from the ensuing function description, the yarn supply apparatus 1 can by anticipation compensate for a future sudden change in yarn consumption. The sensor device 24 furnishes a signal that contains information about the incipient yarn consumption. It does so by recording and reporting the passage of the carriage 9 toward the yarn guide 8. The yarn consumption rises shortly after this report, if the carriage 9 strikes the yarn guide 7 and abruptly accelerates the yarn guide in the intended direction, from the zero value suddenly to an approximately constant value. The signal of the sensor device 24 now indicates that this event is imminent.

The thus-adapted yarn supply can make a yarn store unnecessary even with hard yarns, and the entire yarn travel path can be defined, except for the feeler element 23, by rigidly supported elements 27, 28 and other elements not shown.

In detail, the yarn supply apparatus 1 described thus far functions as follows:

As long as the sensor device 24 does not output a signal, the processor 16 at its output furnishes the control deviation, which corresponds to the difference between the yarn tension ascertained by the yarn tension sensor 22 and the command value furnished by the command value generator 21. The control deviation is converted by the controller in accordance with a P, PI or PID characteristic and is furnished in the form of a pulse train to the disk rotor stepping motor 14 by a trigger circuit contained in the controller 15. The controller may be embodied as either a continuous or a noncontinuous controller. By means of the yarn wheel 13, it furnishes precisely the quantity of yarn required in order to maintain the desired yarn tension and to minimize or nullify the control deviation. Gradual and/or lesser changes in yarn consumption are detected and compensated for on the basis of the yarn tension.

However, an abrupt increase in yarn consumption from zero to the maximum value is imminent when the carriage 9 moves past the sensor device 24 in the direction of the arrow 25. The period of time between the appearance of the signal generated by the sensor device 24 and the abrupt change in yarn consumption depends on the distance of the switching point of the sensor device 24 from the yarn guide 7 and on the speed of the carriage 9. The processor 16 therefore starts the disk rotor stepping motor 14 as soon as it receives the signal from the sensor device 24, or shortly thereafter, and it causes the disk rotor stepping motor 14 to startup at such a speed that the yarn tension initially drops, and a certain yarn reserve is present in the region between the yarn wheel 13 and the yarn guide 7, which reserve prevents the occurrence of an excessive yarn tension.

Figure 5:
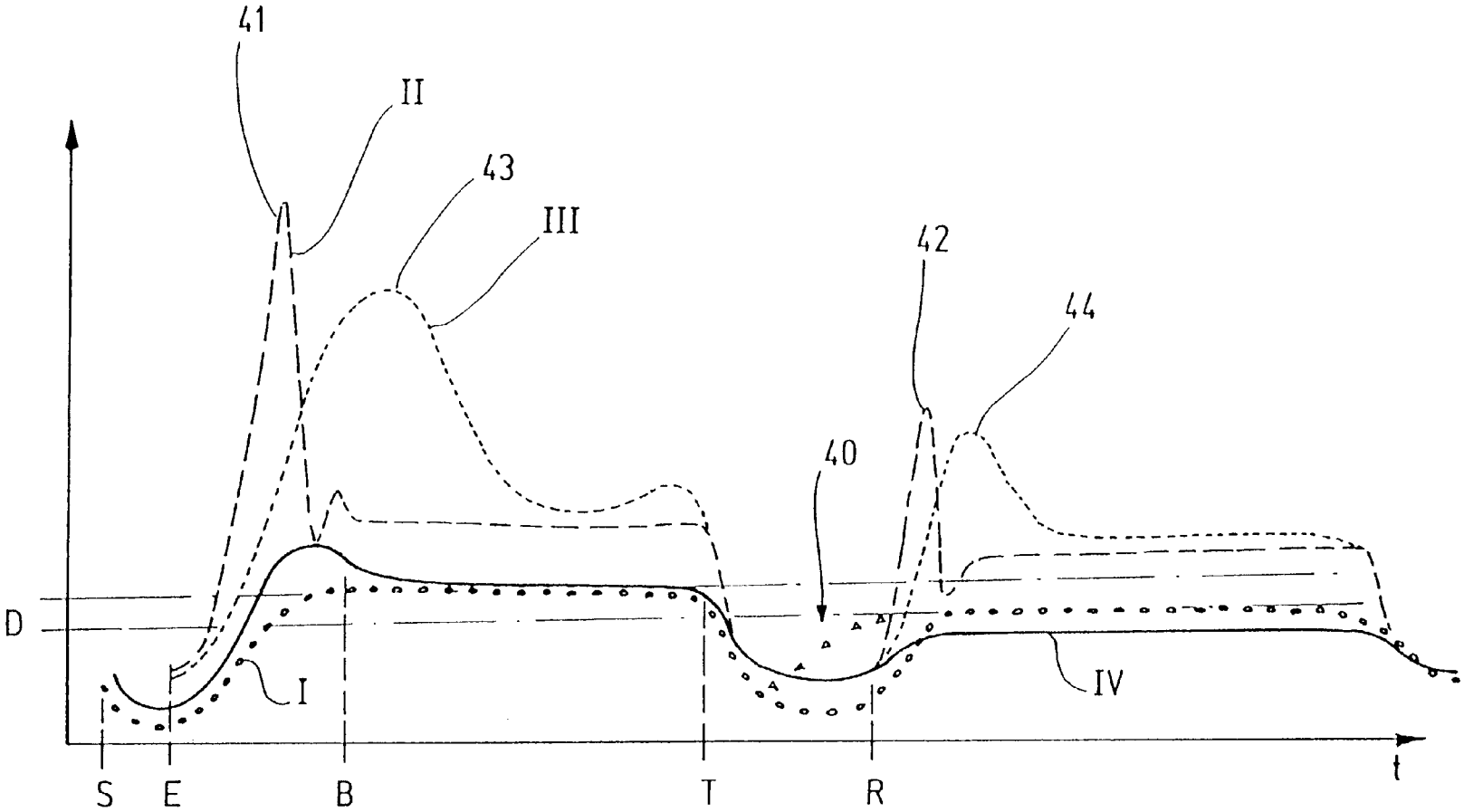
FIG. 5, the course over time of the yarn tension in the forward and return travel of the yarn guide of a flatbed knitting machine in the yarn supply apparatus of FIG. 1, in comparison with the course of time of the yarn tension for various yarn supply apparatuses and yarns known from the prior art.

This process is illustrated in detail in FIG. 5. The curve I marked by tiny circles characterizes the course of the yarn tension over time. While the carriage 9 meets the yarn guide 7 at an engagement time E, the disk rotor stepping motor 14 is already started beforehand, at a starting time S, in response to the signal of the sensor device 24. It initially starts up slowly in accordance with a specified profile, and at the engagement time E it reaches a rotary speed that is less than the rotary speed required to furnish the yarn 6. From the starting time S until the engagement time E, the yarn tension therefore initially drops, because yarn supply is already taking place without corresponding consumption being involved.

At the engagement time E, the yarn consumption jumps from zero to its maximum value. During this time, the disk rotor stepping motor 14 is accelerated, preferably with the maximum possible acceleration, to its expected target rpm, which is attained at a time B. The target rpm is somewhat lower than the rpm required afterward to supply the yarn 6. The target rpm is set lower in order to allow the yarn tension to rise as fast as possible to the command value during the acceleration phase of the disk rotor stepping motor 14, between times S and B. By presupplying yarn 6 between the starting time S and the engagement time E, however, an excessive increase in the yarn tension beyond the desired value is avoided. The simultaneous monitoring of the yarn tension by the yarn tension sensor 22 serves to prevent the yarn tension from dropping in response to an overly generous presupply of yarn.

However, the processor 16 and the controller 15 can also operate as open-loop control, without taking the actual yarn tension into account, between times S and B. Once the disk rotor stepping motor 14 at time B, reaches its target rpm, however, the controller changes over to its closed-loop control mode and adjusts the desired yarn tension precisely. The until then somewhat faded-out signal of the yarn tension sensor 22 now guides the processor and the controller 15.

The drop in yarn tension by a certain slight value before the onset of knitting does not cause any impairment in quality of the knitted goods, because the knitting operation has not yet begun. Conversely, by the avoidance of a tension spike at the onset of knitting, the knitted goods become more uniform and are thus improved in quality.

On attainment of the end of the cycle T, that is, when the yarn guide 7 comes to a stop on the far end of the row 4 from the yarn supply apparatus 1, yarn consumption abruptly ceases. A certain quantity of yarn continues to be supplied as the disk rotor stepping motor 14 comes to a stop (with its moment of inertia, and this causes a certain drop in yarn tension. However, this does no harm, since in this state no loops are as yet being knitted. As yarn consumption continues to occur on the return R of the yarn guide 7, the yarn tension builds up again immediately. Since the yarn consumption in the return leg is relatively slight, the incident change can readily be handled by the controller, so that there is no overswing in yarn tension.

As represented by tiny triangles at 40 in FIG. 5, the yarn tension can also be built up again, in the phase between the cycle end T and the return R, by rotating the disk rotor motor 14 in reverse. A similar effect, as with a brief reverse travel, is attainable by prematurely stopping the disk rotor stepping motor 14. However, to avoid tension spikes, the first of these variants is to be preferred.

FIG. 5 also shows the course of the yarn tension in the yarn supply apparatuses known from the prior art. Curve II, drawn in dashed lines, represents the course over time of the yarn tension in a yarn supply apparatus of the kind known from German Patent DE 36 27 731. This yarn supply apparatus has a yarn store that is formed by a pivotable lever with a terminal eyelet. The yarn extends through this eyelet at an acute angle, so that more or less major pivoting of the lever makes it possible to receive or pay out a yarn reserve. Accelerating the lever on payout of the yarn reserve causes tension spikes 41, 42, which can cause the yarn to tear. Even when elastic yarns are used, considerable voltage spikes 43, 44 occur, as shown by curve III.

If, in a yarn supply apparatus with conventional closed-loop control, a yarn reserve between the yarn wheel in the knitting machine is built up that, lacking mechanically moved elements, is based solely on the intrinsic elasticity of a highly elastic yarn used, a yarn tension course as described by curve actual value in FIG. 5 can be attained. Immediately after the engagement time E, an excessive increase in yarn tension occurs, which in the yarn supply apparatus 1 of FIG. 1 is largely suppressed despite the use of a hard yarn 6.

Figure 2:
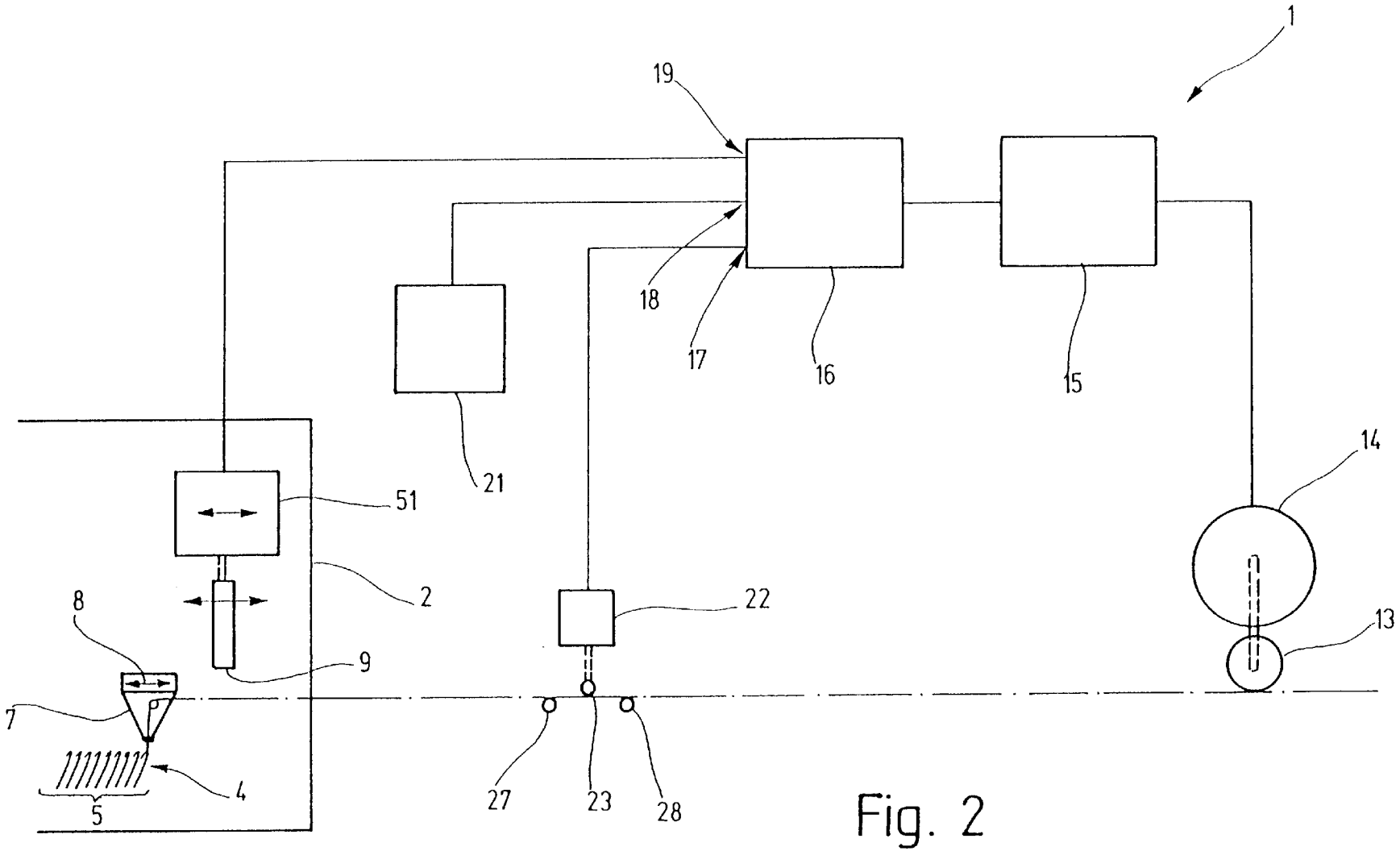
FIG. 2, in a schematic illustration, a flatbed knitting machine with a yarn supply apparatus as in FIG. 1 and with a modified controller, which is guided by the yarn tension and by a motor status of a machine element of the flatbed knitting machine.

A modified embodiment of the yarn supply apparatus 1 can be seen in FIG. 2. In it, instead of the sensor device 24, a sensor 51 that is connected to the additional input 19 of the processor 16 is located on the flatbed knitting machine 2. The additional input 19 in this embodiment is designed such that by way of it, a summand can at least intermittently be added to the difference that has been formed from the signals at the command value input 18 and the actual value input 17. The same effect is attained if the command value generated by the command value generator 21 is lowered somewhat, upon motion of the yarn guide 7 away from the yarn supply apparatus 1, and/or raised somewhat upon motion in the opposite direction (compensation of disturbance variables). This serves to compensate for variable frictional forces that come about in both operating phases because of different yarn speed conditions, and if the increase in tension is correctly dimensioned, the result is an identical yarn tension on both the forward and the return leg. As a result, the difference marked D in FIG. 5 between the forward leg and return leg tension vanishes.

A limitation over time of the disturbance variable compensation can be utilized to bring about an early start of the disk rotor stepping motor 14, which as a result carries out a presupply of yarn.

Figure 3:
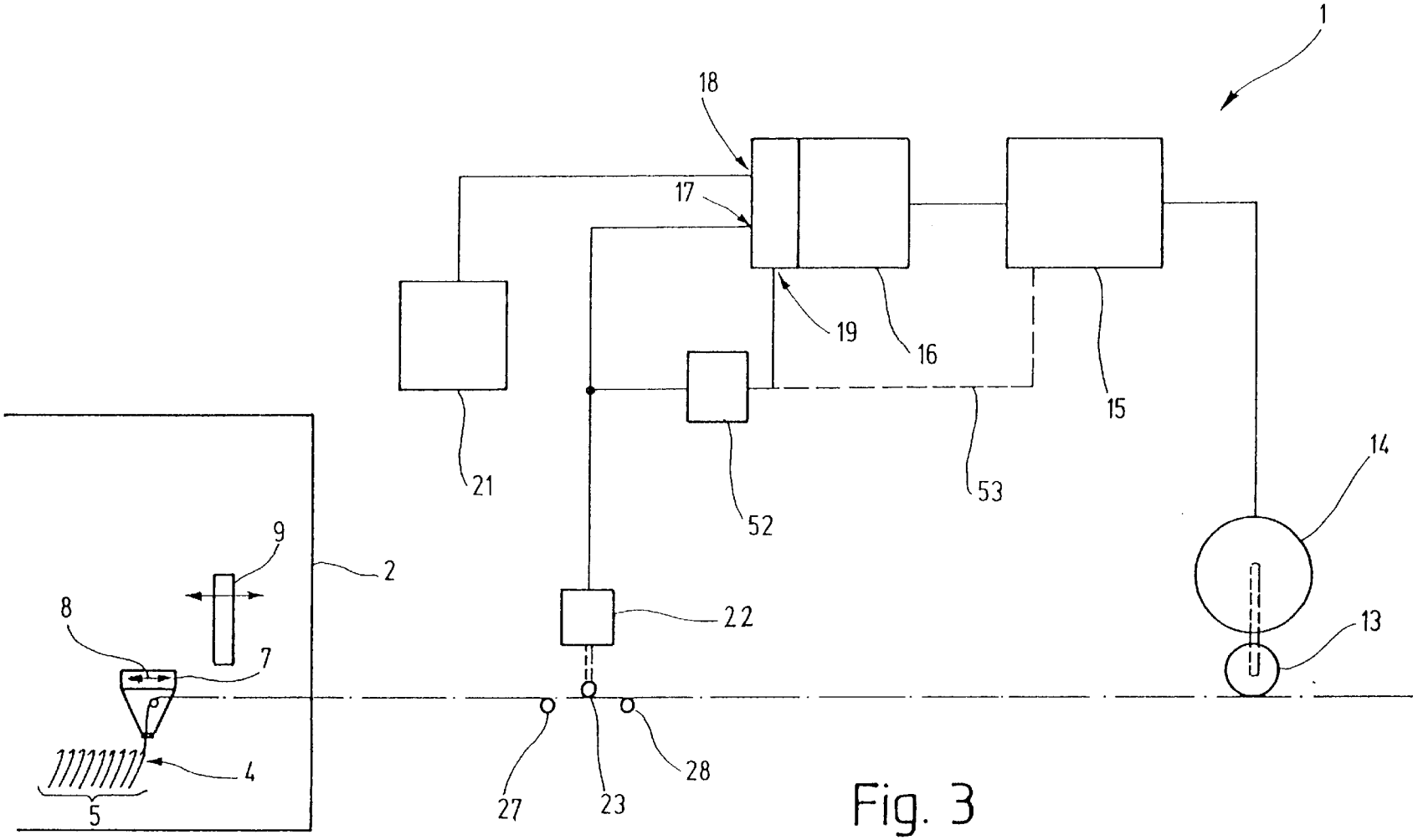
FIG. 3, in a schematic illustration, a knitting machine with a yarn supply apparatus which is triggered by an adaptive controller.

A modified embodiment, shown in FIG. 3, of the yarn supply apparatus 1 makes do without intervention into the flatbed knitting machine 2 or sensors on it. The yarn supply apparatus 1 is provided with a module 52, which investigates the course over time of the yarn tension signal that is output by the yarn tension sensor 22. If recurring structures appear in the course of this signal over time, then the module 52 determines the period, and on the assumption that detected periods will be repeated, it makes a prediction about the yarn tension to be expected within a defined forecast time period. Once incident tension spikes or drops have been correlated with corresponding changes in yarn consumption, the module 52 generates a yarn consumption signal that leads ahead of the actual yarn consumption and that can be used in place of the signals output by the sensor device 24 or the sensor 51 (FIGS. 1 and 2).

In a refined embodiment, the output signal of the module 52 is superimposed on the command value signal of the command value generator 21, so that a command value profile is produced. This is in contrast to the control deviations that have occurred until then, so that the overall result obtained by the superposition is a constant yarn tension.

Instead of the module 52, the processor 16 may also contain a simulation model, from which the expected yarn consumption is determined and can be taken into account in the further close-loop control. The simulation model is a simulation of the controlled system with all the essential influencing factors.

As an alternative, as represented by a dashed-line connection 53 in FIG. 3, the module 52 may also control characteristics of the controller 15, making it possible to attain faster transient phenomena.

Figure 4:
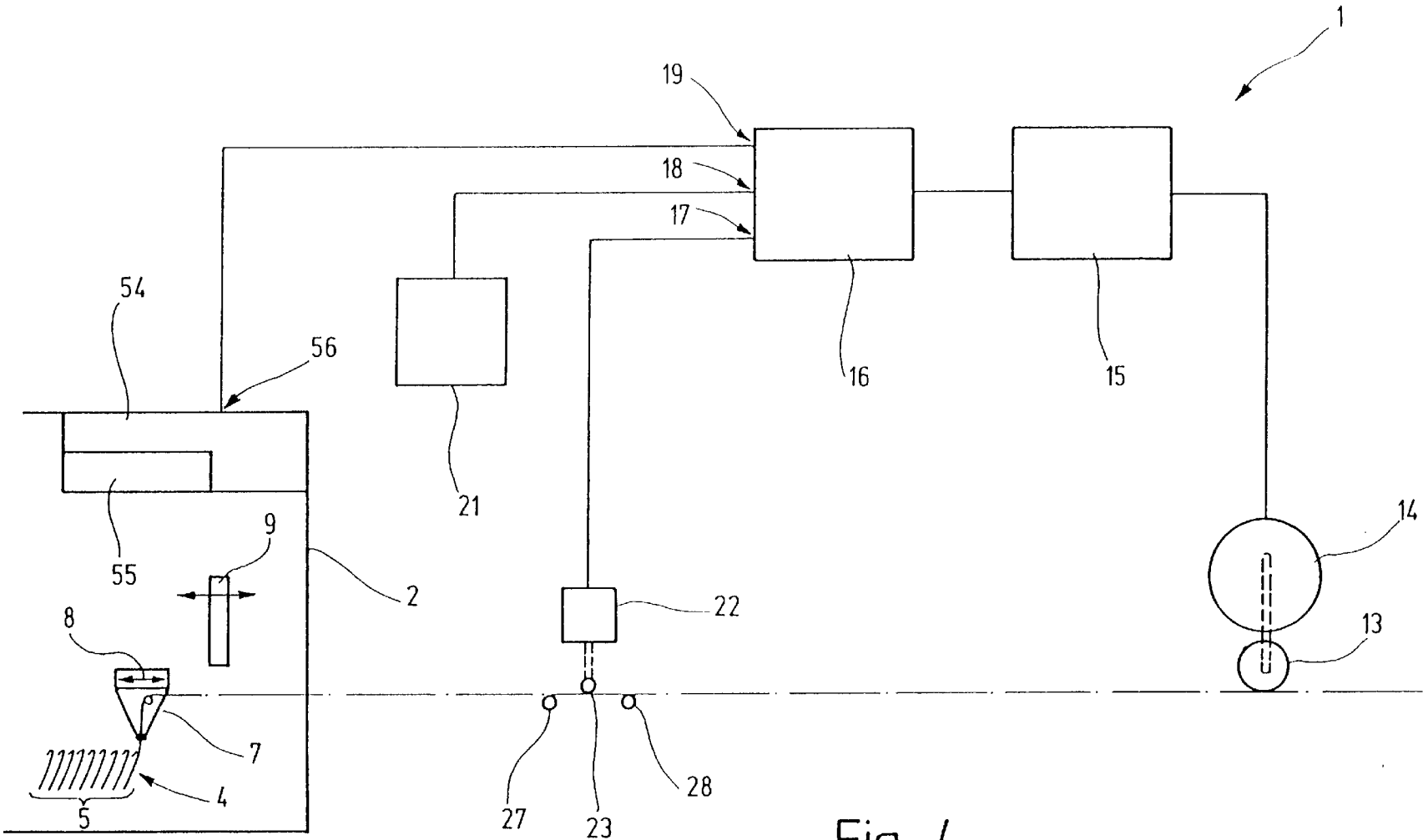
FIG. 4, in a schematic illustration, a flatbed knitting machine with a yarn supply apparatus, whose controller monitors the yarn tension and also receives additional information about the quantity of yarn required both at present and in the future, from a pattern memory of the flatbed knitting machine.

Yarn supply that is maximally adapted to a given knitting operation is attained with a yarn supply apparatus 1 that, as suggested in FIG. 4, is connected to a processing unit 54 present in the knitting machine 2. This unit communicates with a pattern memory 55, from whose data the current and future yarn demand can be calculated. Either the processing unit 54 communicates with machine elements, via sensors not shown in further detail, so that it detects the current operating position of the yarn guide 7 and the needles 4, or the operating position is obtained directly from position values of the open-loop machine controller. At a separate output 56 provided for this purpose, the processing unit 54 outputs signals to the additional input 19 that are processed by the processor 16 in one of the ways described above. They may be processed in the context of disturbance variable compensation, or adaptive closed-loop control, or as additional parameters; the controller then attempts to adjust the yarn supply such that not only is the yarn tension constant but, by anticipating imminent yarn demand, sufficient yarn is supplied. The result is a compromise, which can be attained for instance in that the processor 16 links the signal furnished by the yarn tension sensor 22, and/or the signal of the command value generator 21, with the signal of the processing unit 54. The controller may be embodied such that it processes the applied signals by using fuzzy logic.

In addition, a yarn store, located between the yarn wheel 13 and the flatbed knitting machine 2, can be provided on each of the yarn supply apparatuses 1 described. The yarn store may be embodied as a lever storage means, or in elastic yarns, as a travel path within which the yarn is capable of sufficient resilience.

For supplying hard yarns in particular, a yarn supply apparatus 1 is contemplated that is designed particularly for knitting machines 2 whose yarn demand fluctuates greatly over time. The yarn supply apparatus 1 has a rotor-driven yarn wheel 13, which in the ideal case furnishes yarn directly to the knitting machine 2 or its yarn guides 7 without the interposition of yarn storage devices. The yarn tension is monitored by means of a yarn tension sensor 22, which provides measured value detection for a closed-loop controller 15, 16 that controls the supply by the yarn wheel 13. The controller 15, 16 is also embodied such that it can process signals that contain information about the future yarn demand. Thus in the event of imminent drastic changes in demand, of the kind that in flatbed knitting machines 2 periodically occur at the edges of the knitted goods (turning points of the yarn guide), the controller 15, 16 can react by presupplying yarn or by ceasing to supply yarn. Yarn tension spikes and overly steep yarn tension drops can thus be compensated for. The controller 15, 16 may be designed such that it functions as a closed-loop status controller and intermittently as an open-loop controller. Other provisions, such as disturbance variable compensation, parameter adaptation, or the like, are possible.

We claim:

1. A yarn supply apparatus for supplying a yarn to maintain a constant yarn tension in a knitting machine in which yarn demand fluctuates abruptly over time, the yarn supply apparatus comprising:

a yarn wheel disposed in a yarn path, the yarn wheel storing and supplying yarn;

a drive device coupled to the yarn wheel;

a sensor for detecting the yarn tension and generating a yarn tension signal that characterizes the yarn tension;

a closed-loop controller responsive to the yarn tension signal for controlling the drive device to supply the yarn at a substantially constant tension;

wherein the closed-loop controller (15, 16) is responsive to at least one additional signal which contains information about future yarn demand so as to maintain a substantially constant yarn tension.

2. The yarn supply apparatus of claim 1, wherein the at least one additional signal which contains information about the future yarn demand corresponds to imminent yarn demand.

3. The yarn supply apparatus of claim 1, further including means which produces, from the at least one additional signal, a command value signal that is variable over time.

4. The yarn supply apparatus of claim 3, wherein prior to abruptly ensuing phases of high yarn demand, the command value for the yarn tension is briefly lowered.

5. The yarn supply apparatus of claim 3, wherein the prior to abruptly ensuing phases of absent yarn demand, the command value for the yarn tension is briefly raised.

6. The yarn supply apparatus of claim 1, wherein the command value for the yarn tension corresponds to a command value profile that is adapted to the yarn demand that fluctuates over time.

7. The yarn supply apparatus of claim 6, wherein the command value profile is dependent on at least one of the machine running speed and other machine parameters.

8. The yarn supply apparatus of claim 6, wherein the command value profile is a value for the yarn tension that is constant in each case and can be switched between forward and return travel of a yarn guide.

9. The yarn supply apparatus of claim 1, wherein the drive device (14) is started before yarn demand ensues and is stopped before yarn demand ends.

10. The yarn supply apparatus of claim 1, wherein the requisite yarn supply is determined adaptively by the controller (15, 16, 52, FIG. 3).

11. The yarn supply apparatus of claim 10, wherein a filter (20) is interposed between the tension sensor (22) and the controller (15, 16).

12. The yarn supply apparatus of claim 11, wherein the filter (20) blocks disturbance frequency ranges.

13. The yarn supply apparatus of claim 1, wherein at least one of starting and stopping times for the drive device (14) are specified by machine elements (9) of the knitting machine.

14. The yarn supply apparatus of claim 1, wherein the control characteristic of the controller (14, 15, 52, FIG. 2) is based on at least one of (i) a determination made adaptively and (ii) a determination made on an ongoing basis in accordance with a current operating state of the knitting machine (2).

15. The yarn supply apparatus of claim 1, wherein the requisite yarn supply quantity is determined from data that are stored in a pattern memory (55) for open-loop control of the knitting machine (2).

16. The yarn supply apparatus of claim 1, wherein the yarn tension sensor (22) is essentially free of measurement travel, so that a feeler element (23) which is in contact with the yarn (6) has only a slight measuring stroke.

17. The yarn supply apparatus of claim 16, characterized in that the yarn travel between the yarn wheel (13) and the knitting machine (2) is determined by rigidly supported elements (27, 28) that except for the feeler element (23) are supported in nonresilient fashion.

18. The yarn supply apparatus of claim 1, wherein a yarn store is provided between the yarn wheel (13) and the knitting machine (2), the yarn store being formed by a yarn travel segment between the yarn supply wheel (13) and a knitting station, in which yarn travel segment elastic yarn (6) is guided such that it can expand freely.

19. The yarn supply apparatus of claim 1, wherein the drive device (14) is a stepping motor.

20. The yarn supply apparatus of claim 1, wherein the drive device (14) is a disk rotor motor.

21. The yarn supply apparatus of claim 1, wherein the drive device (14) and the controller (15, 16) are designed such the drive device (14) is operable in two rotational directions.

22. A yarn supply apparatus for supplying yarn to a knitting station of a knitting machine so as to maintain a constant yarn tension even when yarn demand fluctuates abruptly over time, the yarn supply apparatus comprising:

a yarn wheel for storing and supplying yarn;

a motor coupled to the yarn wheel for operatively rotating the yarn wheel;

a tension sensor for detecting the yarn tension and generating a yarn tension signal;

a controller responsive to the yarn tension signal for selectively activating, deactivating and controlling the speed of the motor to supply yarn to the knitting station at a substantially constant tension, the controller also being responsive to at least one additional signal which provides a future yarn demand at the knitting station so as to prevent the occurrence of an excessive yarn tension.

23. The yarn supply apparatus according to claim 22, further comprising a directionally dependent sensor responsive to a motion of a carriage for generating the at least one additional signal.

24. The yarn supply apparatus according to claim 22, further comprising a processor responsive to: a) a command value signal indicative of a desired yarn tension, b) the yarn tension signal, and c) the at least one additional signal, wherein the processor determines a control deviation which is a difference between the command value signal and the yarn tension signal, the processor generating and sending a signal to the controller to change operation of the motor and yarn wheel in response to the at least one additional signal wherein the yarn tension initially drops such that a certain yarn reserve is present in a region between the yarn wheel and the knitting station so as to prevent the occurrence of excessive yarn tension.

25. The yarn supply apparatus according to claim 22, wherein the controller is a closed loop controller.

* * * * *